US006220301B1

(12) United States Patent
Guthler

(10) Patent No.: US 6,220,301 B1
(45) Date of Patent: Apr. 24, 2001

(54) DRAINAGE SYSTEM

(75) Inventor: Harald Guthler, Kussaberg-Kussnach (DE)

(73) Assignee: Renate Guthler (DE)

( * ) Notice: Subject to any disclaimer, the term of this patent is extended or adjusted under 35 U.S.C. 154(b) by 0 days.

(21) Appl. No.: 09/507,161

(22) Filed: Feb. 18, 2000

(30) Foreign Application Priority Data

Feb. 22, 1999 (DE) ..... 199 07 583

(51) Int. Cl.[7] ..... F15D 1/02

(52) U.S. Cl. ..... 138/39; 138/43; 138/45; 138/46

(58) Field of Search ..... 138/37, 39, 43, 138/45, 46

(56) References Cited

U.S. PATENT DOCUMENTS 3,646,971 * 3/1972 Godet ..... 138/46
3,848,858 * 11/1974 Page et al. ..... 138/46
3,894,563 * 7/1975 Pausch ..... 138/45
3,958,605 * 5/1976 Nishizu et al. ..... 138/46
4,095,514 * 6/1978 Roy et al. ..... 138/45
4,515,308 * 5/1985 Jardinjer et al. ..... 138/45
4,633,900 * 1/1987 Suzuki ..... 138/46
4,805,552 * 2/1989 Pagendarm et al. ..... 138/43
4,828,169 * 5/1989 Smith ..... 138/46
5,740,837 * 4/1998 Chiang ..... 138/45

* cited by examiner

*Primary Examiner*—James Hook
(74) *Attorney, Agent, or Firm*—Bachman & LaPointe, P.C.

(57) ABSTRACT

In a drainage system for a conduit having a conduit inflow and a conduit outflow, the intention is that at least one drainage obstacle which can be moved in the direction of flow (X) is provided for limiting, directing, regulating or influencing a stream of water.

21 Claims, 4 Drawing Sheets

DRAINAGE SYSTEM

The present invention relates to a drainage system for a conduit having a conduit inflow and a conduit outflow.

Such drainage systems are known and customary in a very wide variety of shapes and designs. In particular, measures are often necessary for water conservation which are frequently much too expensive in terms of manufacture. For example, the authorities require retaining basins to protect outfalls, i.e. streams, rivers and lakes.

In addition, there is a need for action when newly built areas are developed if conduits in the old area of a town are overloaded. In particular unsealing and drainage are rarely adequate so that either buffer basins have to be constructed or lengths of conduit have to be replaced in order to protect the older parts of the town.

In addition, conventional drainage systems can usually only be regulated and directed at considerable expense, are expensive to maintain and are therefore associated with extremely high operating costs. In addition, the intention is in particular to improve the environmental protection while reducing the volume of the basins and, in particular, that of the conduits. In addition, there is to be a saving or reduction in investment costs.

The present invention is therefore based on the object of providing a drainage system which overcomes the above-mentioned disadvantages and with which a large stream of combined sewage can be slowed down in an easy and cost-effective way, for example when there is heavy rain, the intention being to avoid discharge peaks.

In addition, floods are to be prevented and the operation of sewage treatment plants therefore optimized. In addition, the intention is that it will be possible to use such a drainage system in conventional conduit systems and/or retrofitted into conventional conduit systems while reducing the costs associated with installation, manufacture and maintenance.

The fact that at least one drainage obstacle which can be moved in the direction of flow is provided for limiting, directing, regulating or influencing a stream of water leads to this object being achieved.

In the present invention, a drainage obstacle according to the invention can be introduced into a conventional conduit. Preferably, two drainage obstacles, arranged one opposite the other, are introduced into a conduit. Said obstacles can be moved in an articulated fashion and in the direction of flow, in particular they can be pivoted on conduit walls, in particular secured to an inner wall of the conduit. They are held in a horizontal position with respect to the conduit wall by an energy accumulator element.

A gap is preferably formed between a drainage obstacle and the inner wall or between two adjacent drainage obstacles which are located one opposite the other. Said gap can also be dispensed within a closed position of rest.

A bottom outlet with, if appropriate, a drain which is let into a base in a countersunk fashion may also be provided underneath the drainage obstacle. An overflow may also be provided above an upper edge of the drainage obstacle in the conduit.

In the present invention, water flows into a prechamber of the conduit, and when there are very large quantities of water or mass flow rates, the level in the prechamber, and/or upstream of the drainage obstacle, rises very quickly. As a result, high pressure forces act on the drainage obstacle, which then yield to the pressure forces and correspondingly open a gap which may be formed. In this context, the gap may be enlarged in order to conduct onward the desired quantities of water so that, as far as possible, there is no overflow over the threshold. This system preferably operates in a purely mechanical way and can also be regulated in a purely mechanical way.

This serves essentially to reduce and absorb peak loads. Particularly in the case of rain events, the effect of the drainage obstacles is utilized in a selective fashion to dam up water. This serves as a brake on the drainage. Such drainage systems, in particular drainage obstacles, can be used as systems whose length is divided into sections or which are even in the form of a cascade. They are also suitable, in particular, for installation in previously existing shafts or conduits.

A calculated discharge is conducted onward, for example, to the next mount, via the bottom outlet between the base and at least one drainage obstacle. As rain increases, damming up occurs upstream of the at least one drainage obstacle. The substances contained in the water are precipitated and are conveyed to the sewage treatment part by the bottom current via the drain or via the bottom outlet.

Thus, a coarse separation of the combined sewage from impurities or pollutant loading can also be performed so that the rise in water mass is free of them. As a result, the quantity of water which is relieved by the opening of the drainage obstacle under the effect of pressure has less pollutant loading, which also leads to a reduction in the peaks. Overloaded conduits can therefore convey the quantity of water whose drainage is delayed.

It is not necessary to replace the conduits, and the volumes of new basins can be correspondingly reduced.

This drainage system can be configured by means of conduit network calculation and the dimensions of the drainage obstacles can correspondingly be determined precisely by such calculations.

In particular, optimizing wastewater systems by activating retention spaces in sewage systems and delaying drainage by the use of the drainage system according to the invention enables both existing and also new conduits to be utilized, while drainage peaks are reduced and discharges are slowed down.

In addition, floods can be avoided, while adjoining sewage treatment operations can also be optimized.

The complete conduit network can be operated in purely mechanical terms as a sponge in a very cost-effective way requiring little maintenance. In addition, such a drainage system can be retrofitted into any shaft and is particularly easy to regulate. The frequency of flooding can be minimized and as a result the loading of outfalls can be reduced.

Further advantages, features and details of the invention emerge from the following description of preferred exemplary embodiments and with reference to the drawing, in which.

Figure 1:
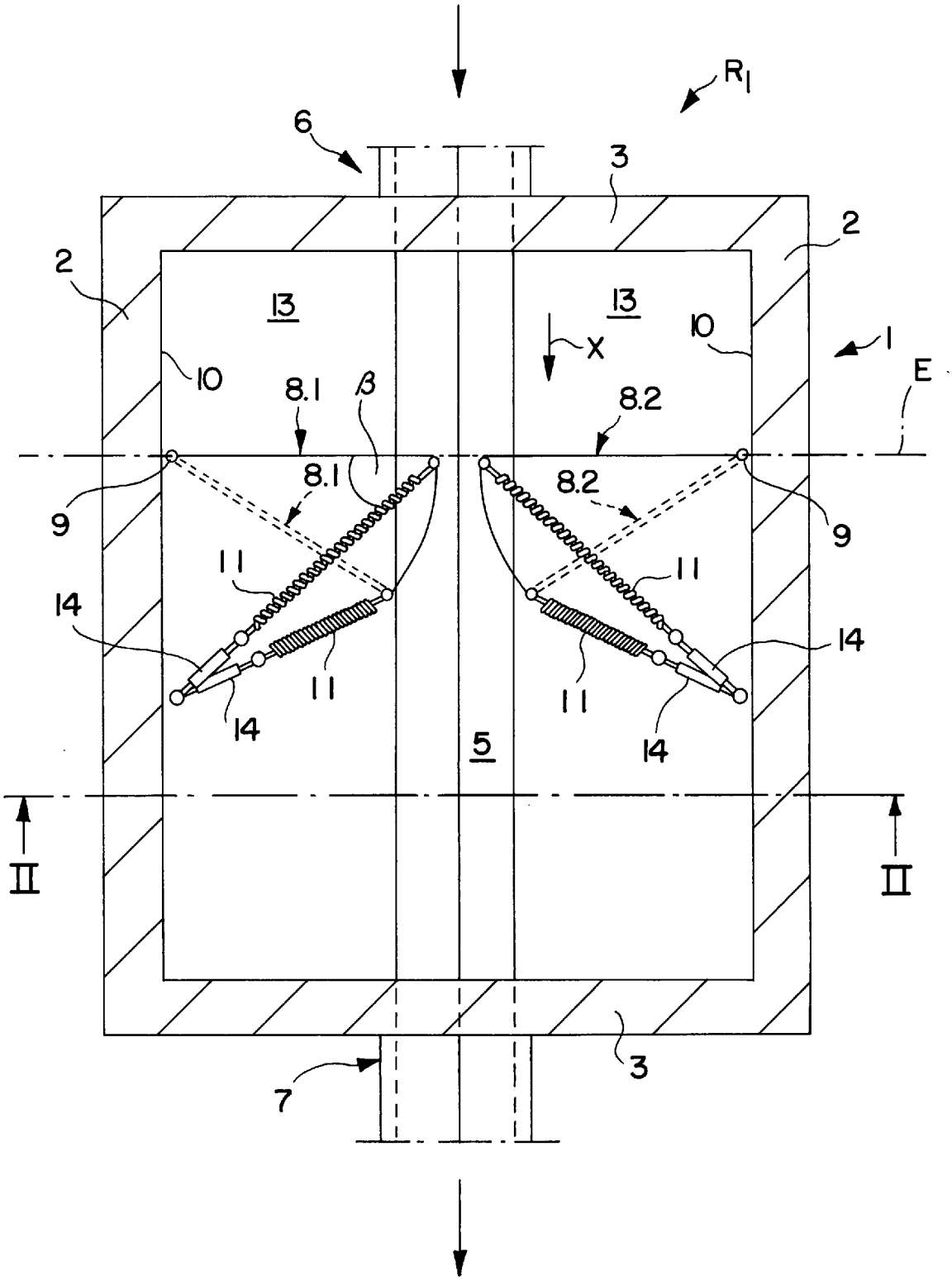
FIG. 1 shows a schematically illustrated plan view of a drainage system for a conduit.

According to FIG. 1, a drainage system $R_1$ according to the invention has a conduit 1 which is formed from lateral conduit walls 2. At the ends, the conduit 1 can be closed off by means of end walls 3. However, a conduit 1 which is open at the end is also within the scope of the present invention.

Figure 2:
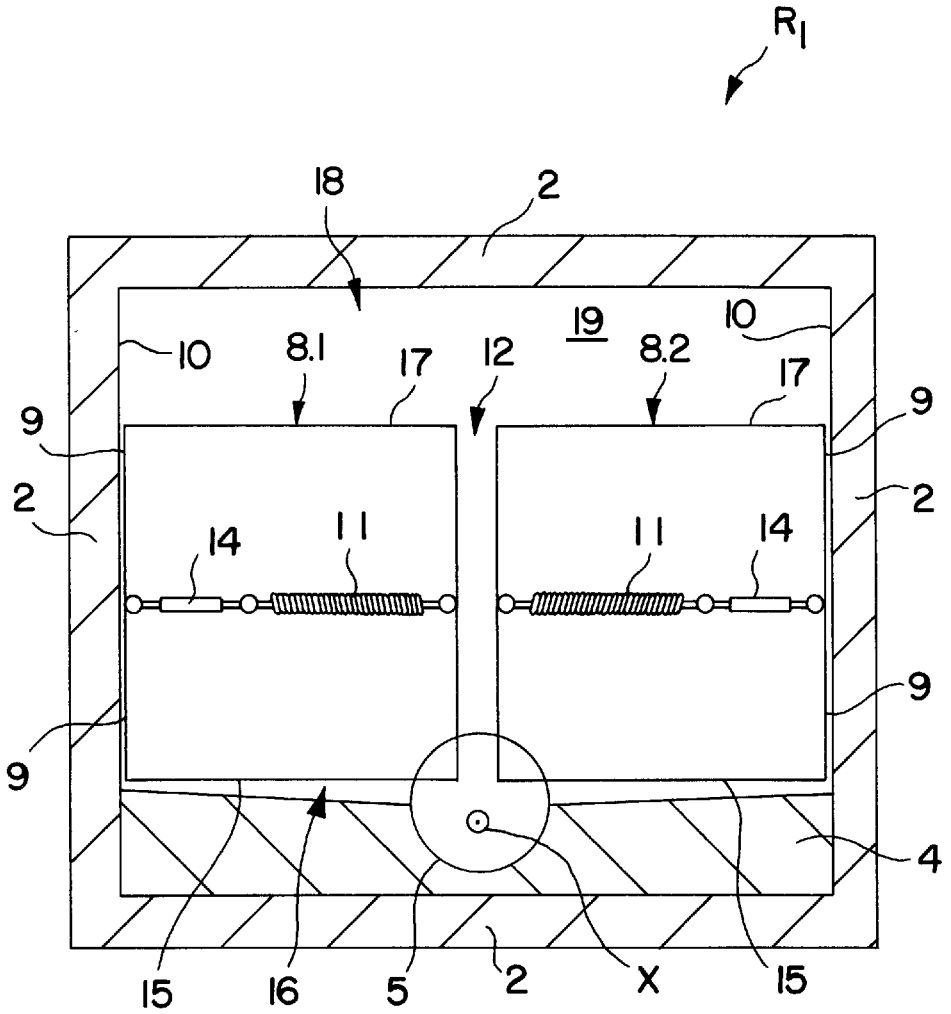
FIG. 2 shows a cross section through the drainage system, in particular through the conduit according to FIG. 1 along the line II—II.

In cross section, as illustrated in particular in FIG. 2, the conduit 1 is formed from the conduit walls 2 in the manner of a rectangle or square.

A base 4 forms a lower boundary, a countersunk drain 5 being preferably formed in the center of the base 4. The base 4 preferably extends in the center, with a slight incline with respect to the drain 5. The drain 5 may be of square, rectangular or even semicircular design.

The water flows in a direction of flow X via a conduit inflow 6 through the conduit 1 to a conduit outflow 7. Between the conduit inflow 6 and conduit outflow 7, the conduit 1 is preferably provided with a slight negative gradient.

However, it is important in the present invention that at least one drainage obstacle 8.1, 8.2 is introduced in the conduit 1, such as is apparent, in particular, in FIGS. 1 and 2. The drainage obstacle 8.1, 8.2 is connected in an articulated fashion by means of a joint 9 to an inner wall 10 of the conduit, and is mounted in a pivotable fashion, in particular in the direction of flow X.

The drainage obstacle 8.1, 8.2 is preferably formed in the manner of a plate made of symmetrical plate elements on which an energy accumulator element 11, designed in particular as a pressure spring element, acts in an articulated fashion, preferably at the other end of the joint 9, and is also connected in an articulated fashion to the inner wall 10 of the conduit wall 2.

In this context, in a position of rest or home position, the energy accumulator element 11 and the plate element of the drainage obstacle 8.1 preferably enclose an angle $\beta$ of approximately 45°.

In a position of rest, the drainage obstacles 8.1, 8.2, in particular their plate elements, lie in a plane E, and are preferably perpendicular to the conduit wall 2 or to the inner wall 10 of the conduit.

In this context, a gap 12 is formed through which water can flow, in particular wastewater or the like, which enters the conduit 1 through the conduit inflow 6 in the direction of flow X. The gap is formed between the two drainage obstacles 8.1, 8.2.

If the liquid level rises strongly in a prechamber 13 of the conduit 1, the pressure on the two drainage obstacles 8.1, 8.2 increases, said drainage obstacles 8.1, 8.2 yielding to the pressure of the masses of water by compression of the energy accumulator element 11. In this way, the drainage obstacles 8.1, 8.2 are moved in a purely mechanical way in the direction of flow X, with the result that the gap 12 is enlarged. A considerably larger volume flow of water can be moved through this larger gap, with the result that in this way the drainage obstacle 8.1, 8.2 regulates itself automatically.

In order to make fine adjustments of a position of rest, a trimming device 14 may be provided, said trimming device 14 limiting the length of the energy accumulator element 11 and in particular the position of the drainage obstacle 8.1, 8.2. In addition, consideration should be given to changing mechanically the spring stiffness or the spring constant, or even a prestress of the energy accumulator element 11 in order to be able to influence the spring characteristics.

The water which flows out through the gap 12 then passes through the conduit 1, in particular through the conduit outflow 7 to the outside and can be conducted onward there.

As is also clear from FIG. 2, an opening is formed underneath a lower edge 15 of the drainage obstacle 8.1, 8.2, in particular a bottom outlet 16 being formed in the manner of a gap which is of slit-like design. The drain 5 which is let into the base 4 is also associated with the bottom outlet 16. The bottom outlet 16 can be changed by means of a vertical adjustment of the at least one drainage obstacle 8.1 to 8.3.

An overflow 18, which forms an overflow orifice 19, adjoins an upper edge 17 of the drainage obstacle 8.1, 8.2. Said overflow orifice serves as an additional protection against the ingress of large amounts of water, but is not used if the drainage system is configured correctly.

The water flows at maximum up to the upper edge 17 of the outflow obstacles 8.1, 8.2.

The method of operation of the present exemplary embodiment is as follows:

If water, wastewater, rainwater or the like flows into the conduit 1 via the conduit inflow 6, in the case of small amounts the water is directed through the drain 5, in particular the dry-weather drain. If the water level rises, it flows through the entirety of the bottom outlet 16 and at least partially through the gap 12.

In the case of strongly rising water, the water can be dammed up in the prechamber 13, in which case when a certain degree of pressure is applied to the drainage obstacles 8.1, 8.2, their energy accumulator elements 11 yield in the direction of flow X and pivot upward.

As a result, the gap 12 is continuously opened, permitting a relatively large amount of water to flow into the following conduit 1. As a result, a drainage delay is formed by retention spaces or damming-up spaces. This permits rainwater to be treated.

In addition, this reduces drainage peaks, undesired damming up is prevented and it becomes possible to use retention spaces.

However, it is also important with the present invention that the quantities of water are controlled and directed and in particular influenced, in a purely mechanical way as a result of the pivoting of the drainage obstacles 8.1, 8.2 under the application of pressure. As a result, such drainage systems $R_1$ can be manufactured, maintained and regulated very cost-effectively.

The intention is that the scope of the present invention will also include the fact that, for example, the energy storage elements 11 can be replaced by torsion spring elements, helical spring elements or the like which can also be arranged in the vicinity of the joints 9. The intention is that no limit will be placed on the invention in this respect.

The present invention also includes the fact that, for example, only a single drainage obstacle 8.1, 8.2 is introduced into the conduit 1 in the manner described above. In this context, the gap 12 can then be formed between the inner wall 10 of the conduit wall 2 and the plate element. The latter can also be given a narrow setting or be preset to any desired width as a basic setting. The method of operation is that described above.

Figure 3:
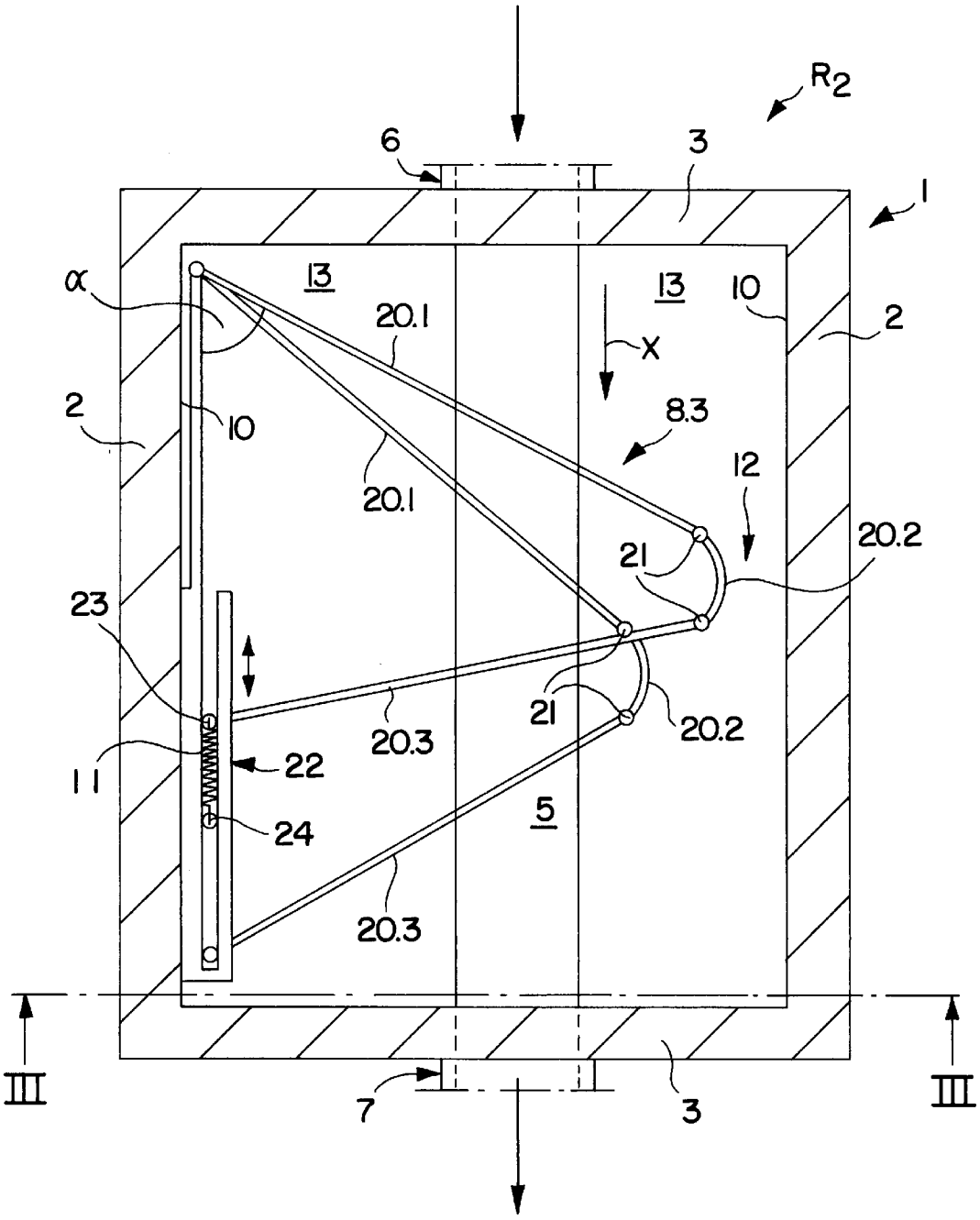
FIG. 3 shows a schematically illustrated plan view of a drainage system for a conduit according to FIG. 1 as a further exemplary embodiment.

In a further exemplary embodiment of the present invention according to FIG. 3, a drainage system $R_2$ is shown, which is correspondingly constructed in the manner described above. Essentially, details on the individual components will not be given again here. However, there is a difference in that a drainage obstacle 8.3 is formed on one side by one of the two conduit walls 2 composed of a plurality of elements 20.1 to 20.3. The first element 20.1 extends at an angle $\alpha$ of approximately 0° to 90° into the conduit 1, the element 20.1 being positioned at an angle in the direction of flow X.

The preferably plate-like element 20.1 is adjoined by an arc-like element 20.2. The elements 20.1, 20.2 are connected to one another in an articulated fashion by means of connecting joints 21.

The element 20.2 is adjoined by an element 20.3 which is formed in a plate-like fashion, is preferably slightly inclined with respect to the conduit wall 2 in the direction of flow, in particular with respect to the inner wall 10 of the conduit, and leads there into a guide rail 22 and is moveably mounted there by means of a roller element 23. In this context, the roller element 23 may be a wheel, gearwheel or the like.

If water, wastewater or the like is then fed to the conduit 1, a pressure is exerted on the element 20.1 which is of planar construction, if the water level in the conduit 1 rises. As a result, the gap 12 which is formed between the element 20.2 and the inner wall 10 of the conduit is enlarged in the direction of flow X, as is illustrated by broken lines in FIG. 3, by displacing the drainage obstacle 8.3, in particular by moving one end of the element 20.3 in the guide rail 22. A larger amount of water can flow past.

An energy accumulator element 11 can be connected at one end to the element 20.3 in the guide rail 22 and can move said element 20.3 back into a vertical home position or position of rest if said element 20.3 is, for example, designed as a pressure spring.

At the other end, the position of the energy accumulator element 11 can be changed in the guide rail 22 by means of a locking device 24, for example a securable gear, wheel or the like. As a result, it is possible to influence the position of the element 20.3, and in particular to influence prestressing of the energy accumulator element 11.

The scope of the present invention is also to include the fact that two such drainage obstacles 8.3 can, in accordance with the exemplary embodiment in FIG. 1, also be arranged located one opposite the other in order to change in the manner described above a gap 12 which is preferably arranged in the center.

The idea of the present invention should also include the fact that two drainage obstacles 8.1, 8.2 and 8.3 which are located one opposite the other are provided in the conduit 1 and are also arranged outside a common plane E, for example offset in the conduit.

Figure 4:
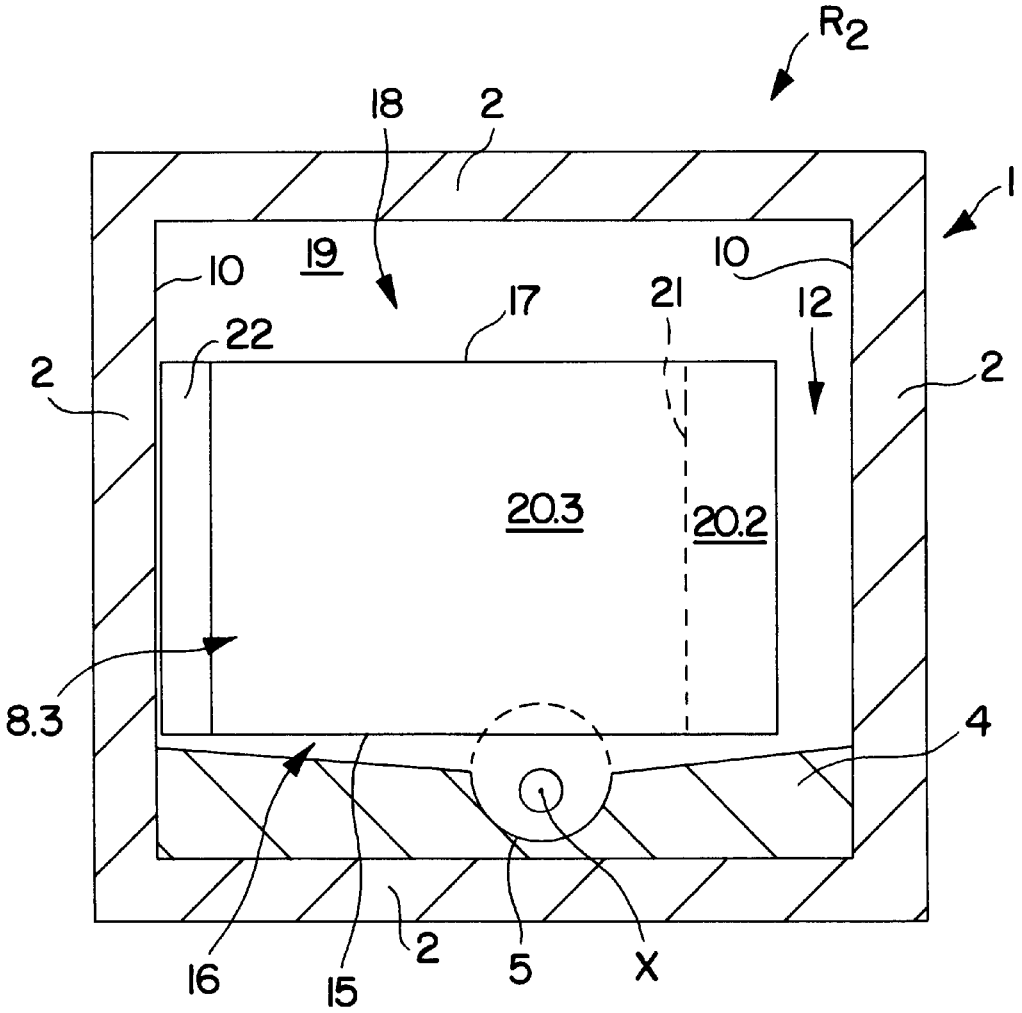
FIG. 4 shows a schematically illustrated cross section through the drainage system, in particular through the conduit according to FIG. 3 along the line III—III.

FIG. 4 shows a similar cross section corresponding to FIG. 2, the bottom outlet 16 being formed underneath the lower edge 15 of the drainage obstacle 8.3, and the overflow 18 being provided with an overflow orifice 19 above the upper edge 17. However, the gap 12 is formed between the inner wall 10 of the conduit and the arc-like element 20.2.

What is claimed is:

1. A drainage system, which comprises: a conduit having a conduit water inflow and a conduit water outflow; at least two drainage obstacles in said conduit which are movable in the direction of water flow for at least one of limiting, directing, regulating and influencing a stream of water; wherein said drainage obstacles are arranged in a position of rest approximately transversely with respect to the conduit; and a vertical gap formed by said drainage obstacles through which water can flow, wherein said drainage obstacles are connected to the conduit in an articulated fashion by means of at least one joint, and wherein when pressure is applied to said drainage obstacles by means of a stream of water, said drainage obstacles are movable in the direction of waterflow and the vertical gap is enlarged.

2. The drainage system according to claim 1, wherein two drainage obstacles are arranged one opposite the other in said conduit, said drainage obstacles being arranged transversely with respect to the conduit and both lying in a common plane.

3. The drainage system according to claim 1, wherein said vertical gap is formed between one of (1) said drainage obstacles and a conduit wall, and (2) between two drainage obstacles which are located one opposite the other in the conduit.

4. The drainage system according to claim 1, including an overflow formed above an upper edge of at least one drainage obstacle in the conduit.

5. The drainage system according to claim 4, wherein when the stream of water rises up to said upper edge, a pivoting movement of said drainage obstacles in the direction of water flow takes place.

6. The drainage system according to claim 1, including an at least partially gap-like bottom outlet in said conduit which can be varied in size by means of a vertical adjustment of at least one drainage obstacle.

7. The drainage system according to claim 6, including a base of said conduit and a centrally provided drain in said base, wherein said base includes an incline therein with respect to said drain.

8. The drainage system according to claim 1, including two of said drainage obstacles each of which being connected to the conduit in an articulated fashion by means of joints.

9. The drainage system according to claim 1, wherein at least one drainage obstacle includes at least one energy accumulator element which is connected to the conduit and to the drainage obstacle in an articulated manner.

10. The drainage system according to claim 9, including a trimming device for fine adjustment of the position of at least one drainage obstacle, said trimming device adjoining the energy accumulator element.

11. The drainage system according to claim 9, wherein said energy accumulator is a pressure spring element.

12. The drainage system according to claim 11, wherein the spring constant of the energy accumulator element can be varied mechanically and adjusted.

13. The drainage system according to claim 1, wherein said at least one drainage obstacle is a plate-like member.

14. The drainage system according to claim 1, wherein said at least one drainage obstacle is a hollow element.

15. The drainage system according to claim 1, wherein said drainage obstacles are formed from a plurality of elements which are connected to one another in articulated fashion by means of at least one connecting joint.

16. The drainage system according to claim 15, wherein said drainage obstacles comprise a multi-element member.

17. The drainage system according to claim 16, wherein said multi-element member includes a first element thereof arranged with an incline with respect to the conduit wall at an angle of up to 90° in the conduit, a second element thereof adjoining said first element in the manner of an arc and joint, and a third element thereof establishing an inclined connection to the conduit in the position of rest.

18. The drainage system according to claim 17, wherein said third element is guided and mounted at one end along the conduit wall in a guide rail.

19. The drainage system according to claim 18, wherein the third element is connected in the guide rail to an energy accumulator element.

20. The drainage system according to claim 19, wherein said energy accumulator element is inserted in the guide rail so as to be capable of varying its position.

21. The drainage system according to claim 1, wherein when the application of pressure is reduced by decreasing the stream of water, said drainage obstacles are moved counter to the direction of water flow and as a result the vertical gap is made smaller.

* * * * *